United States Patent [19]

Porter et al.

[11] 4,013,033

[45] Mar. 22, 1977

[54] WEED GUARD FOR TROLLING MOTORS

[76] Inventors: Stephen G. Porter; Theodore J. Adams, both of 249 NE. 32nd St., Fort Lauderdale, Fla. 33334

[22] Filed: Jan. 28, 1976

[21] Appl. No.: 653,272

[52] U.S. Cl. ..... 115/42

[51] Int. Cl.[2] ..... B63H 5/16

[58] Field of Search ..... 115/17, 18 E, 42, 70

[56] References Cited

UNITED STATES PATENTS 3,802,377 4/1974 Porter et al. ..... 115/42

*Primary Examiner*—Trygve M. Blix
*Assistant Examiner*—Stuart M. Goldstein
*Attorney, Agent, or Firm*—Clarence A. O'Brien; Harvey B. Jacobson

[57] ABSTRACT

A truncated cone-shaped hollow body is provided and defined by a plurality of graduated size and axially spaced circular band portions interconnecting with a plurality of elongated circumferentially spaced slant height extending band portions with generally trapezoidal shaped openings or passages being defined between pairs of adjacent interconnecting circular and slant height band portions. The small diameter end of the body includes a generally radially inwardly projecting circumferentially extending annular portion and a cylindrical extension formed integrally with an extending outwardly of the inner marginal portion of the annular portion. The body includes a longitudinal slot extending the full length of the extension, through the annular portion and the two circular band portions adjacent the annular portion are interrupted between a pair of adjacent slant height band portions between which a radial plane of the body containing the said slot extends. The slant height angle of the slant height band portions relative to the center axis of the body lies between 35° and 60° (preferably approximately 45°) and a clamp structure is provided for clamping the slotted cylindrical extension about the generally cylindrical housing of a trolling motor, the slotted portions of the extension, annular portion and the interrupted portions of the circular band portions adjacent the annular portion defining a passageway through which to receive the depending blade-like skeg of an associated outboard trolling motor.

10 Claims, 4 Drawing Figures

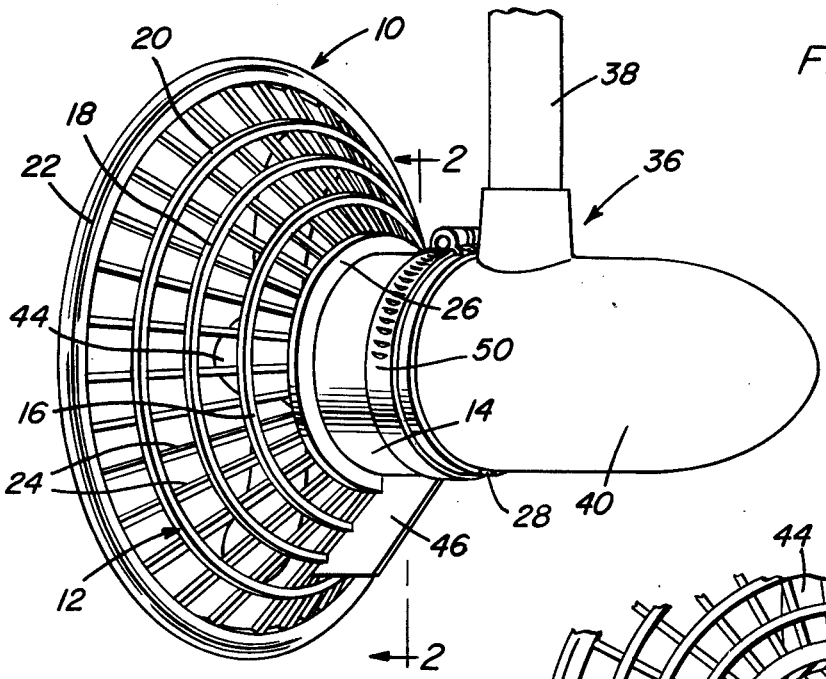
Fig. 1
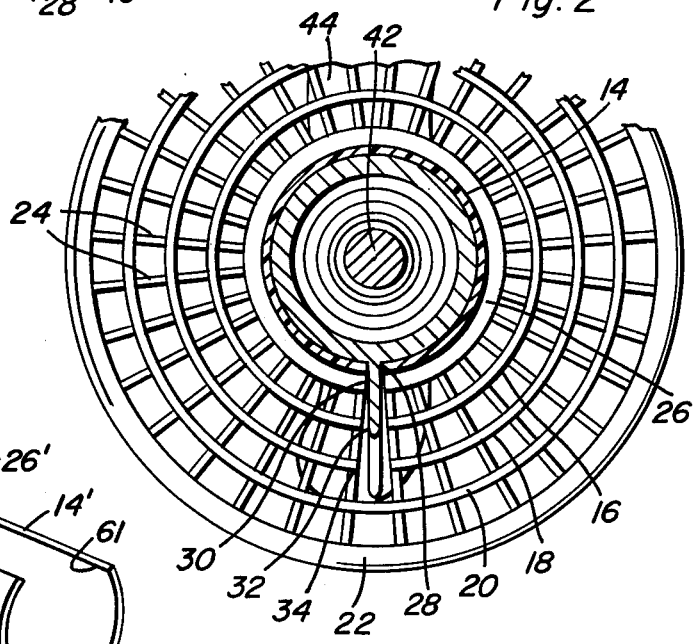
Fig. 2
Fig. 4
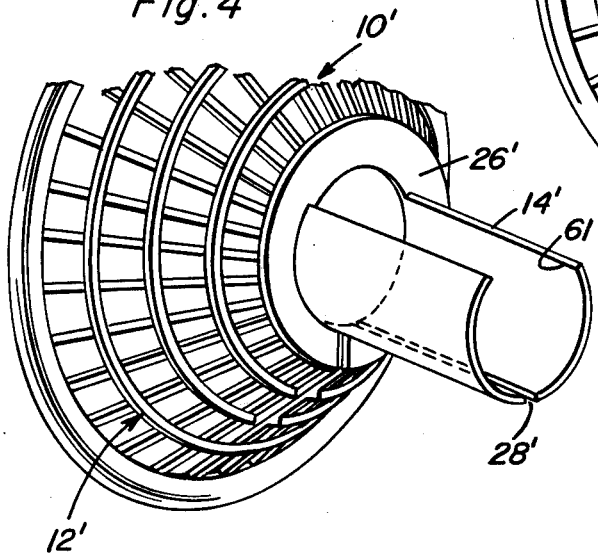
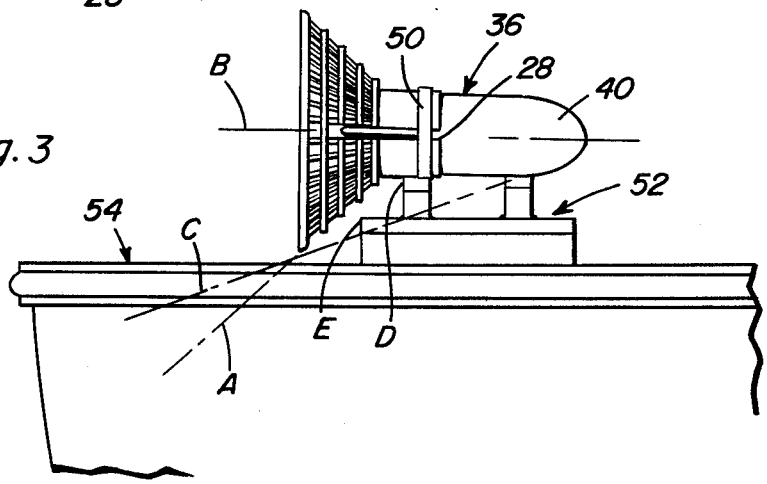
Fig. 3

WEED GUARD FOR TROLLING MOTORS

BACKGROUND OF THE INVENTION

Various forms of combined weed and safety guards for outboard motors have been heretofore provided. Some of these guards have been specifically design for use in conjunction with increasingly popular electric trolling motors and are utilized in shoal waters in which weeds, sticks, rocks, and other underwater obstructions are many times present in abundance.

Examples of various forms of weed and safety guards for marine propeller assemblies are disclosed in U.S. Pat. Nos. 2,135,162, 2,136,628, 2,244,217, 3,025,825, 3,035,538 and 3,802,377, the latter being closest in construction and purpose to the improved weed and safety guard of the instant invention.

Many electric trolling motor units are operated by a remote control toe-heel foot pedal to control steerage of the electric motor and quick steerage may be accomplished through the utilization of the toe-heel foot pedal control. However, when operating an electric trolling motor in shoal waters in which weeds are present, the propeller of the trolling motor may often become entangled with weeds. Further, the propeller of the trolling motor will often strike other underwater obstacles resulting in damage to the propeller. The entanglement of weeds about the propeller of an electric trolling unit not only reduces the efficiency of the trolling motor as a propulsion force, but also increases the resistance of the water on the trolling motor during steering operations and quick and precise control through the utilization of the conventional toe-heel foot pedal control is greatly hindered.

While various forms of previously known weed and safety guards for use on outboard motors are capable of protecting the associated propeller against striking underwater objects, such previously known guards are not well suited, for various reasons, for use on electric trolling motors. With some forms of guards it is difficult and expensive to produce guards of different sizes for mounting on different size outboard motor lower units, some guards are constructed so rigid as to overly protect the propeller of a trolling motor and be capable of transmitting substantially all of the shock of impact with an underwater object to the mounting structure therefor to the associated trolling motor and yieldable guard disclosed in our prior U.S. Pat. No. 3,802,377 is constructed in a manner so as to interfere with deck storage of the trolling motor while the latter is not in use.

BRIEF DESCRIPTION OF THE INVENTION

This invention comprises an improvement over the weed guard disclosed in our prior U.S. Pat. No. 3,802,377.

The weed and safety guard of the instant invention is constructed in a manner whereby it may be readily mass produced by injection molding and the structure of the guard further enables the mounting portion thereof to be readily molded of different sizes by utilizing the same mold and an insert therefor. Still further, the general configuration of the propeller guarding portion of the instant invention is such to provide maximum frontal area of the water passages defined therethrough, maximum stiffness with resiliency capability through the utilization of a readily available injection molding material, such as polypropylene, and the ability of the associated outboard motor, with the guard attached thereto, to be stored on the deck of an associated boat by conventional deck storage hardware without injury being inflicted upon the guard.

The main object of this invention is to provide a weed guard which may be readily manufactured of different sizes for use on different size propeller shaft housings of electric trolling motors.

Another object of this invention, in accordance with the immediately preceding object, is to provide a guard which will not interfere with conventional deck storage of the associated outboard trolling motor.

Still another object of this invention is to provide a guard having maximum frontal area water flow passages formed therethrough.

A further important object of this invention is to provide a guard having sufficient stiffness to protect the associated propeller against striking an underwater obstruction and yet which is sufficiently resilient to cushion the impact of the guard with an underwater object so as to thereby lessen the amount of the shock of impact transmitted to the mounting structure for the associated trolling motor.

Yet another important object of this invention is to provide a guard which will effectively guard the associated propeller against entanglement with weeds.

A final object of this invention to be specifically enumerated herein is to provide a propeller guard for an electric trolling motor which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

FIG. 1 is a perspective view of the lower end portion of an electric trolling motor with the propeller guard of the instant invention mounted in operative association with the propeller shaft housing and propeller of the trolling motor;

FIG. 2 is an enlarged fragmentary vertical transverse sectional view, taken substantially upon a plane indicated by the section line 2—2 of FIG. 1;

FIG. 3 is a side elevational view of the assemblage illustrated in FIG. 1 with the lower end of the trolling motor disposed on its side and resting upon a deck mounted electric motor storage unit and illustrating the manner in which the over-all configuration of the guard prevents it from being injured by contact with the deck mounted storage unit; and FIG. 4 is a fragmentary perspective view of a modified form of guard adapted to be operatively associated with an electric trolling motor having a smaller diameter propeller shaft housing.

DETAILED DESCRIPTION OF THE INVENTION

Referring now more specifically to the drawings, the numeral 10 generally designates the propeller guard of the instant invention. The guard 10 includes a hollow truncated cone-shaped body referred to in general by the reference numeral 12 and including a cylindrical extension 14 projecting endwise outwardly from the minor diameter end of the body 12. The body 12 is defined by a plurality of graduated size and axially spaced circular band portions 16, 18, 20 and 22 intersecting or interconnecting with integral elongated circumferentially spaced band portions 24 extending along the slant height of the body 12. The pairs of adjacent interconnecting band portions 16, 18, 20, 22 and 24 define trapezoidal shaped openings or water passages. The largest circular band portion 22 is thickened so as to define a reinforced band zone extending about the major diameter end portion of the body 12 and the forward ends of the band portions 24 are anchored to the outer peripheral marginal edge of a radially extending annular portion 26. The inner periphery of the annular portion 26 supports and is formed integrally with the rear end of the forwardly projecting cylindrical extension 14.

The cylindrical extension 14 is fully longitudinally slotted as at 28, the annular portion 26 is radially slotted as at 30 and the circular band portions 16 and 18 are interrupted as at 32 and 34, respectively, in order to define a lower slot.

With attention now invited more specifically to FIGS. 1 and 2 of the drawings, there may be seen an electric trolling motor referred to in general by the reference numeral 36 including a depending support shaft or portion 38 and a horizontally elongated front-to-rear extending electric motor housing 40 supported from the lower end of the depending support portion 38. The electric motor housing 40 encloses an electric motor (not shown) including a front-to-rear extending rotary output shaft 42 upon which a marine propeller 44 is mounted. The propeller 44 is disposed at the rear end of the housing 40 and the latter also includes a lower depending longitudinally extending edge skeg 46.

The body 12 (including the annular portion 26 and the extension 14) is constructed of stiff but bendable and somewhat resilient material of high impact resistance, such as polypropylene, and is readily manufacturable by injection molding process.

The aforementioned lower slot defined by the slot 28, the slot 30 and the interrupted portions 32 and 34 of the band portions 16 and 18 receives the skeg 46 therethrough when the guard 10 has its extension 14 telescoped over the rear portion of the housing 40. In order to secure the extension 14 to the housing 40, a clamping band 50 is telescoped over and tightly clamped about the extension 14 rearward of the support shaft or portion 38.

As illustrated in FIGS. 1 and 2, the effective inside diameter of the extension 14 is 3 inches. Accordingly, the diameter of the major diameter end portion of the body 12 is approximately 9 inches and is therefore sufficient in size to loosely enclose substantially trolling motor propellers.

Further, it will be noted from FIG. 3 of the drawings that the housing 40 is resting upon a conventional electric trolling motor mounting and storage assembly referred to in general by the reference numeral 52 mounted on the bow of the boat referred to in general by the reference numeral 54 and with the housing 40 in a generally horizontal position with its left side facing downwardly. The slant height angle (A) relative to the longitudinal center line (B) is preferably 45°, although this angle may be between 35° and 60°. The line (C) represents a slant height angle of approximately 20° such as that utilized on the body of the weed guard disclosed in our prior U.S. Pat. No. 3,802,377. However, it may be seen that this previously patented weed guard, if mounted on the housing 40, would contact the mounting and storage assembly 52 at points (D) and (E) and thus be damaged by the assembly 52. Accordingly, the greater slant height angle of 45° of the instant body 12 provides sufficient clearance to enable the guard 10 to be mounted on the housing 40 in its stored position illustrated in FIG. 3.

It will also be appreciated that the slant height length of the body 12 is considerably shorter than the slant height of a similar body extending along slant height (C) and, therefore, that the body 10 is stiffer, for a given effective cross-sectional area of the band portions 16, 18, 20, 22 and 24, than a similarly constructed body extending along the slant height (C). Therefore, if a body, such as the body 12, is to be constructed so as to afford the same resistance to bending as a similarly constructed body including the slant height (C), the cross-sectional areas of the band portions 16, 18, 20, 22 and 24 may be considerably smaller resulting in a savings of materials and weight. Further, the effective cross-sectional areas of the openings defined between adjacent interconnected band portions 16, 18, 20, 22 and 24 is increased, thus affording for greater water flow through the openings and less resistance to forward movement of the guard 10. Still further, the increases slant height angle of the body 12 requires the utilization of only four circular band portions 16, 18, 20 and 22, whereas a similar guard having the slant height (C) would require approximately eight circular band portions. Therefore, the effective frontal area of the combined water passages or openings of the body 12 is further increased. Finally, inasmuch as each of the openings or water flow passages is disposed on a greater slant height angle than the slant height angle (C), their effective frontal areas are greater for still further water flow therethrough.

It may, therefore, be seen that by utilizing a conical body having a reasonably great slant height angle a more efficient guard than heretofore known is provided. Also, by providing the extension 14 of the guard 10 with a full length slot also extending through the annular portion 26 and into the body area by means of the interrupted portions 32 and 34 of the band portions 16 and 18, flexibility of the lower portion of the body (which is that portion of the body 12 which most frequently strikes an underwater object) is increased. Also, by utilizing the annular portion 26 and the injection molding process of manufacture, the mold for the guard 10 may be readily provided with an insert enabling a different size and slightly modified extension corresponding to the extension 14 to beprovided, see FIG. 3.

FIG. 3 illustrates a modified form of guard referred to in general by the reference numeral 10' and including components similar to many of the components of the guard 10 identified with corresponding prime reference numerals . The guard 10' differs from the guard 10 in that the radial inward extent of the annular portion 26' is greater than the radial inward extent of the annular portion 26. Further, in addition to the extension 14' being provided with a slot 28' corresponding to the slot 28, the extension 14' is axially longer than the extension 14 and includes an upper slot 61 which is considerably wider than the lower slot 28' and terminates at the annular portion 26'. The slot 61 is utilized on the extension 14' so as to receive the lower end of a support shaft or portion corresponding to the portion 38, but which is positioned further to the rear along the associated housing corresponding to the housing 40. In addition, by providing a longer extension 14', a pair of clamps 50 may be used, one in front of the corresponding support shaft or portion 38 and one to the rear of the corresponding portion 38.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with an outboard motor of the type including a depending support portion provided with a horizontally elongated marine propeller drive housing at its lower end portion, said depending support portion positioned between forwardly and rearwardly projecting portions of the housing, said housing including a front to rear extending shaft journaled therein having a marine propeller mounted on its rear end, a weed guard comprising a hollow generally horizontal truncated cone-shaped body provided with axially and circumferentially spaced water passages formed therethrough, said body being constructed of light weight, stiff but somewhat flexible material, the minor diameter end of said body including an integral endwise outwardly projecting cylindrical extension snugly telescoped over the rearwardly projecting portion of said housing closely forward of said propeller and with said cone-shaped body disposed entirely rearward of said depending support portion, and clamp means clamping said extension about said housing with the center axis of said body at least generally coinciding with the center axis of said housing and the major diameter end of said body loosely enclosing said marine propeller, the slant height angle of the body relative to its center axis being between 35° and 60°.

2. In combination with an outboard motor of the type including a depending support portion provided with a horizontally elongated marine propeller drive housing at its lower end portion, said housing including a front to rear extending shaft journaled therein having a marine propeller mounted on its rear end, a weed guard comprising a hollow generally horizontal truncated cone-shaped body provided with axially and circumferentially spaced water passages formed therethrough, said body being constructed of light weight, stiff but somewhat flexible material, the minor diameter end of said body including an integral endwise outwardly projecting cylindrical extension snugly telescoped over the rear of said housing closely forward of said propeller, and clamp means clamping said extension about said housing with the center axis of said body at least generally coinciding with the center axis of said housing and the major diameter end of said body loosely enclosing said marine propeller, said cylindrical extension being provided with a full length longitudinal slot therethrough extending generally along a radial plane of said extension.

3. The combination of claim 2 wherein said cylindrical extension includes a second wider full length longitudinal slot therethrough generally diametrically opposite the first mentioned slot and receiving the lower end of said depending support portion therethrough.

4. The combination of claim 2 wherein said body is of one-piece construction and constructed of high impact plastic material.

5. The combination of claim 2 wherein said clamp means comprises a compression type clamp member extending about said extension and clamping the latter to said housing.

6. The combination of claim 2 wherein said body includes an integral radially inwardly projecting circumferentially extending annular portion at its minor diameter end portion, said cylindrical extension being integral with the inner periphery of said annular portion.

7. The combination of claim 2 wherein said body is defined by a plurality of first graduated size and axially spaced circular band portions interconnecting with a plurality of second integral elongated circumferentially spaced band portions extending along the slant height of said coneshaped body, said water passages being defined between pairs of adjacent interconnecting first and second band portions.

8. In combination with an outboard motor of the type including a depending support portion provided with a horizontally elongated marine propeller drive housing at its lower end portion, said housing including a front to rear extending shaft journaled therein having a marine propeller mounted on its rear end, a weed guard comprising a hollow generally horizontal truncated cone-shaped body provided with axially and circumferentially spaced water passages formed therethrough, said body being constructed of light weight, stiff but somewhat flexible material, the minor diameter end of said body including an integral endwise outwardly projecting cylindrical extension snugly telescoped over the rear of said housing closely forward of said propeller, and clamp means clamping said extension about said housing with the center axis of said body at least generally coinciding with the center axis of said housing and the major diameter end of said body loosely enclosing said marine propeller, said body including an integral radially inwardly projecting circumferentially extending annular portion at its minor diameter end portion, said cylindrical extension being integral with the inner periphery of said annular portion, said body being defined by a plurality of first graduated size and axially spaced circular band portions interconnecting with a plurality of second integral elongated circumferentially spaced band portions extending along the slant height of said cone-shaped body, said water passages being defined between pairs of adjacent interconnecting first and second band portions, said cylindrical extension including a full length longitudinal slot disposed along a radial plane of the center axis guard and extending into and through said annular portion, at least the circular band portion closest to said annular portion being interrupted between a first pair of adjacent second band portions between which said radial plane extends.

9. The combination of claim 8 wherein the circular band portion second from said annular portion is also interrupted between said first pair of adjacent second band portions.

10. In combination with an outboard motor of the type including a depending support portion provided with a horizontally elongated marine propeller drive housing at its lower end portion, said housing including a front to rear extending shaft journaled therein having a marine propeller mounted on its rear end, a weed guard comprising a hollow generally horizontal truncated cone-shaped body provided with axially and circumferentially spaced water passages formed therethrough, said body being constructed of light weight, stiff but somewhat flexible material, the minor diameter end of said body including an integral endwise outwardly projecting cylindrical extension snugly telescoped over the rear of said housing closely forward of said propeller, and clamp means clamping said extension about said housing with the center axis of said body at least generally coinciding with the center axis of said housing and the major diameter end of said body loosely enclosing said marine propeller, said cylindrical extension being provided with a full length longitudinal slot therethrough extending generally along a radial plane of said extension, said extension being circumferentially continuous from one side of said slot to the other side thereof.

* * * * *